US007913761B2

(12) United States Patent
Pratt et al.

(10) Patent No.: US 7,913,761 B2
(45) Date of Patent: Mar. 29, 2011

(54) SYSTEM AND METHOD FOR ENHANCED WELLBORE PERFORATIONS

(75) Inventors: Dan Pratt, Benbrook, TX (US); Joseph Haney, Bayview, ID (US); Thomas C. Montanez, Cleburne, TX (US); Matthew Clay, Fort Worth, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 12/356,362

(22) Filed: Jan. 20, 2009

(65) Prior Publication Data

US 2009/0183916 A1 Jul. 23, 2009

Related U.S. Application Data

(63) Continuation-in-part of application No. 11/252,958, filed on Oct. 18, 2005, now Pat. No. 7,621,332.

(60) Provisional application No. 61/022,753, filed on Jan. 22, 2008.

(51) Int. Cl.
*E21B 43/11* (2006.01)

(52) U.S. Cl. ..... 166/297; 175/4.6

(58) Field of Classification Search ..... 166/297, 166/298, 55; 175/4.6
See application file for complete search history.

(56) References Cited

U.S. PATENT DOCUMENTS

| | | | | |
|---|---|---|---|---|
| 4,491,185 | A * | 1/1985 | McClure | 175/4.56 |
| 6,354,219 | B1 | 3/2002 | Pratt et al. | |
| 6,991,044 | B2 * | 1/2006 | Zhang et al. | 175/4.6 |
| 2007/0084604 | A1 | 4/2007 | Haney et al. | |
| 2007/0240880 | A1 | 10/2007 | Olsen | |

* cited by examiner

*Primary Examiner* — William P Neuder
(74) *Attorney, Agent, or Firm* — Mossman, Kumar & Tyler, PC

(57) ABSTRACT

A method for perforating a subterranean formation includes positioning a shaped charge and a reactant composite material in a carrier; positioning the carrier in the wellbore; detonating the shaped charge; and disintegrating the reactant composite material using a shock generated by the detonated shaped charge. The method may also include initiating a first deflagration by using carbon and heat resulting from the detonation of the shaped charge and an oxygen component of the disintegrated reactant composite material. A system for performing the method may include a carrier, a shaped charge positioned in the carrier; and a reactant composite material positioned in the carrier. The reactant composite material may be configured to disintegrate upon detonation of the shaped charge.

15 Claims, 6 Drawing Sheets

SYSTEM AND METHOD FOR ENHANCED WELLBORE PERFORATIONS

CROSS-REFERENCE TO RELATED APPLICATIONS

This application takes priority from U.S. Provisional Application Ser. No. 61/022,753, filed Jan. 22, 2008. This application is a continuation-in-part of U.S. patent application Ser. No. 11/252,958, filed Oct. 18, 2005 now U.S. Pat. No. 7,621,332, titled "System and Method for Performing Multiple Downhole Operations."

BACKGROUND OF THE DISCLOSURE

1. Field of Disclosure

The present disclosure relates to an apparatus and method for perforating a well casing and/or a subterranean formation.

2. Description of the Related Art

Hydrocarbon producing wells typically include a casing string positioned within a wellbore that intersects a subterranean oil or gas deposit. The casing string increases the integrity of the wellbore and provides a path for producing fluids to the surface. Conventionally, the casing is cemented to the wellbore face and is subsequently perforated by detonating shaped explosive charges. When detonated, the shaped charges generate a jet that penetrates through the casing and forms a tunnel of a short distance into the adjacent formation. Often, the region that is perforated, and in particular the walls of the tunnel, may become impermeable due to the stress applied to the formation by the perforating jet as well as stresses that may be caused during the firing of the perforating gun. The loss of permeability and other harmful effects, such as the introduction of debris into the perforation, may adversely affect the flow of hydrocarbons from an intersected hydrocarbon deposit.

In aspects, the present disclosure addresses the need for perforating devices and methods that provide cleaner and more effective well perforations.

SUMMARY OF THE DISCLOSURE

The present disclosure provides devices and methods for efficiently perforating a formation. In aspects, an illustrative method for perforating a formation intersected by a wellbore may include positioning a shaped charge and a reactant composite material in a carrier; positioning the carrier in the wellbore; detonating the shaped charge; and disintegrating the reactant composite material using a shock generated by the detonated shaped charge. The method may also include initiating a first deflagration by using carbon and heat resulting from the detonation of the shaped charge and an oxygen component of the disintegrated reactant composite material. In embodiments, the method may also include initiating a second deflagration using heat from the first deflagration. Such initiating may include applying the heat to an oxygen component of the disintegrated reactant composite material and a fuel. The fuel may be supplied by a case of the shaped charge and/or a support member for the shaped charge. The support member may be a tube or strip. In embodiments, the reactant composite material may include an oxidizer and an inert binder. In one configuration, the reactant composite material may not include a fuel component. In other configurations, the reactant composite material may include an oxidizer, a fuel component and an inert binder. Also, the reactant composite material may be formulated to be oxygen overbalanced in any of these embodiments.

In aspects, the present disclosure provides a system for perforating a formation intersected by a wellbore. The system may include a carrier, a shaped charge positioned in the carrier; and a reactant composite material positioned in the carrier. The reactant composite material may be configured to disintegrate upon detonation of the shaped charge. In arrangements, the reactant composite material may be interposed between shaped charges. Also, the reactant composite material may include an oxygen component in an amount sufficient to consume substantially all of the carbon resulting from detonation of the shaped charge.

In aspects, the present disclosure further provides a method for perforating a formation intersected by a wellbore. The method may include positioning a plurality of shaped charges and a plurality of pellets formed at least partially of reactant composite material in a carrier; positioning the carrier in the wellbore; disintegrating the plurality of pellets by detonating the plurality of shaped charges; generating a first quantity of gas using carbon and heat resulting from the detonation of the shaped charge and an oxygen component of the disintegrated reactant composite material; and generating a second quantity of gas by applying heat resulting from the generation of the first quantity of gas to an oxygen component of the disintegrated reactant composite material and a fuel.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
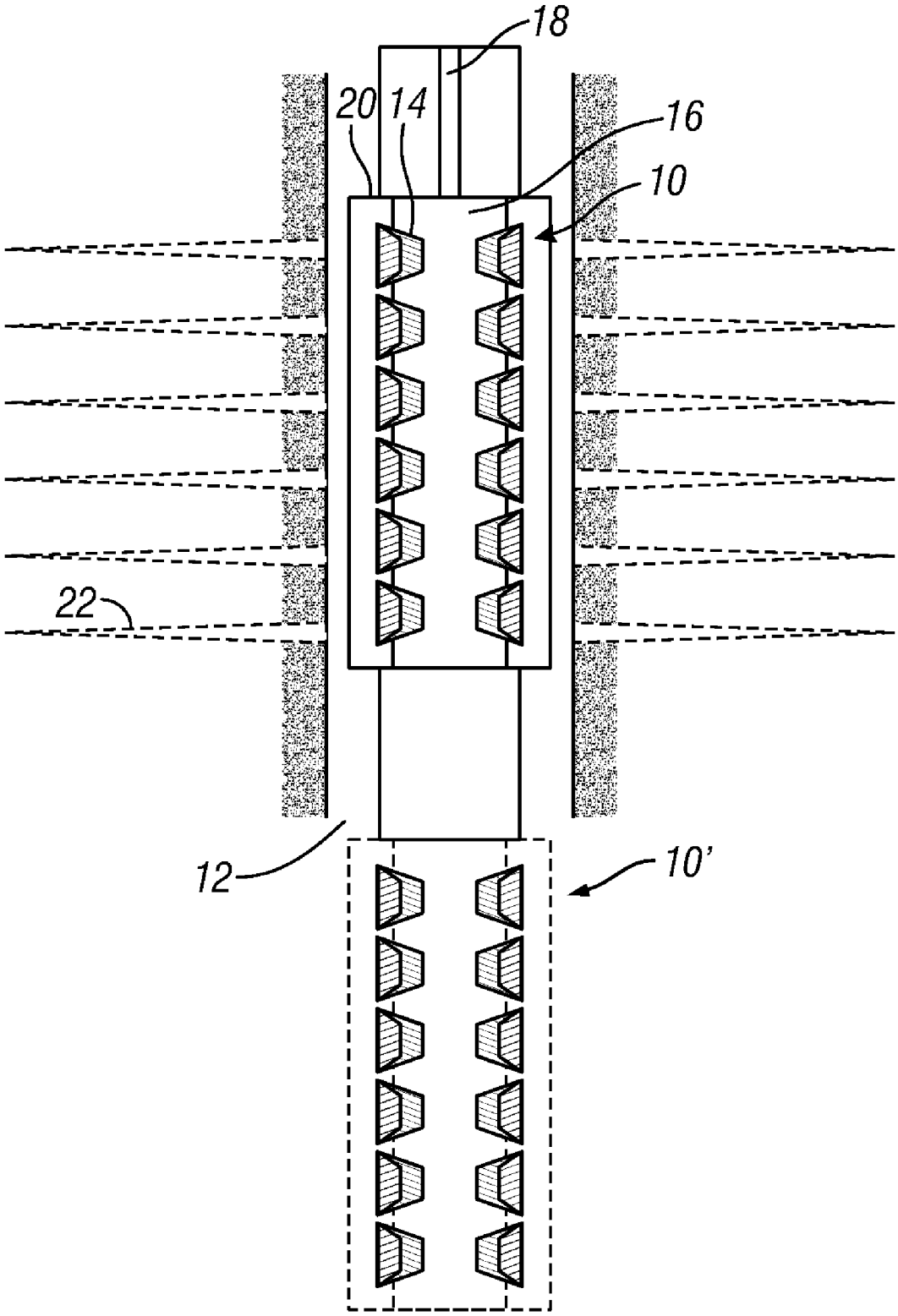
FIG. 1 is a schematic sectional view of one embodiment of an apparatus of the present disclosure as positioned within a well penetrating a subterranean formation.

As will become apparent below, the present disclosure provides a safe and efficient device for enhanced perforation of a subterranean formation. In aspects, the present disclosure uses a gas-generating material carried within a perforating gun that, when activated, produces a high-pressure gas that cleans the perforations resulting from the detonation of the shaped charges in the perforating gun.

Conventionally, the rapidity of the chemical reaction of an explosive may be used as a method of classification. Explosive materials, which react very violently, are often classified as high explosives. These materials are typically used for applications requiring extremely high pressures dissipated over a very short time (e.g., microseconds). For purposes of this disclosure, such reactions will be referred to as a high order reaction or high order detonation, or simply explosion. Some explosive materials may be formulated to react more slowly. These materials, which may be classified as low explosives, may release a large amount of energy over a relatively longer time period (e.g., milliseconds). This relatively slowly released energy may be more useful as a propellant where the expansion of the combustion gases is used to do work. For purposes of this disclosure, such reactions will be referred to as a low order reaction or low order detonation, or simply a deflagration. Embodiments according to the present disclosure may use both of these distinct chemical reactions. For example, in some embodiments, the high order reaction will be followed by a low order reaction. In other embodiments, two distinct low order reactions may occur. In still other embodiments, a high order reaction may be followed by two distinct low order reactions. Illustrative systems, methods and devices that enhance wellbore perforation activities utilizing such reactions are discussed in greater detail below.

The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as a system made up of several components or as a combination of two or more features, it should be understood that the individual components or individual features may themselves represent advancements over the prior art and may be utilized separate and apart from any give system or combination. Moreover, no feature or combination of features should be construed as essential unless expressly stated as essential.

Referring initially to FIG. 1, there is shown a perforating gun 10 disposed in a wellbore 12. Shaped charges 14 are inserted into and secured within a charge holder tube 16. A detonator or primer cord 18 is operatively coupled in a known manner to the shaped charges 14. The charge holder tube 16 with the attached shaped charges 14 are inserted into a carrier housing 20. Any suitable detonating system may be used in conjunction with the perforating gun 10 as will be evident to a skilled artisan. The perforating gun 10 is conveyed into the wellbore 12 with a conveyance device that is suspended from a rig or other platform (not shown) at the surface. Suitable conveyance devices for conveying the perforating gun 10 downhole include coiled tubing, a drill pipe, a wireline, a slick line, or other suitable work string which may be used to position and support one or more guns 10 within the wellbore 12. In some embodiments, the conveyance device can be a self-propelled tractor or like device that move along the wellbore. In some embodiments, a train of guns may be employed, an exemplary adjacent gun being shown in phantom lines and labeled with 10'.

In one embodiment, the perforating gun 10 is configured to perforate and fracture a formation in a single trip, the perforations being enumerated with 22. As will be described more fully below, the material for producing a high-pressure gas for cleaning perforations in the formation is carried in a suitable location in the gun 10.

Figure 2:
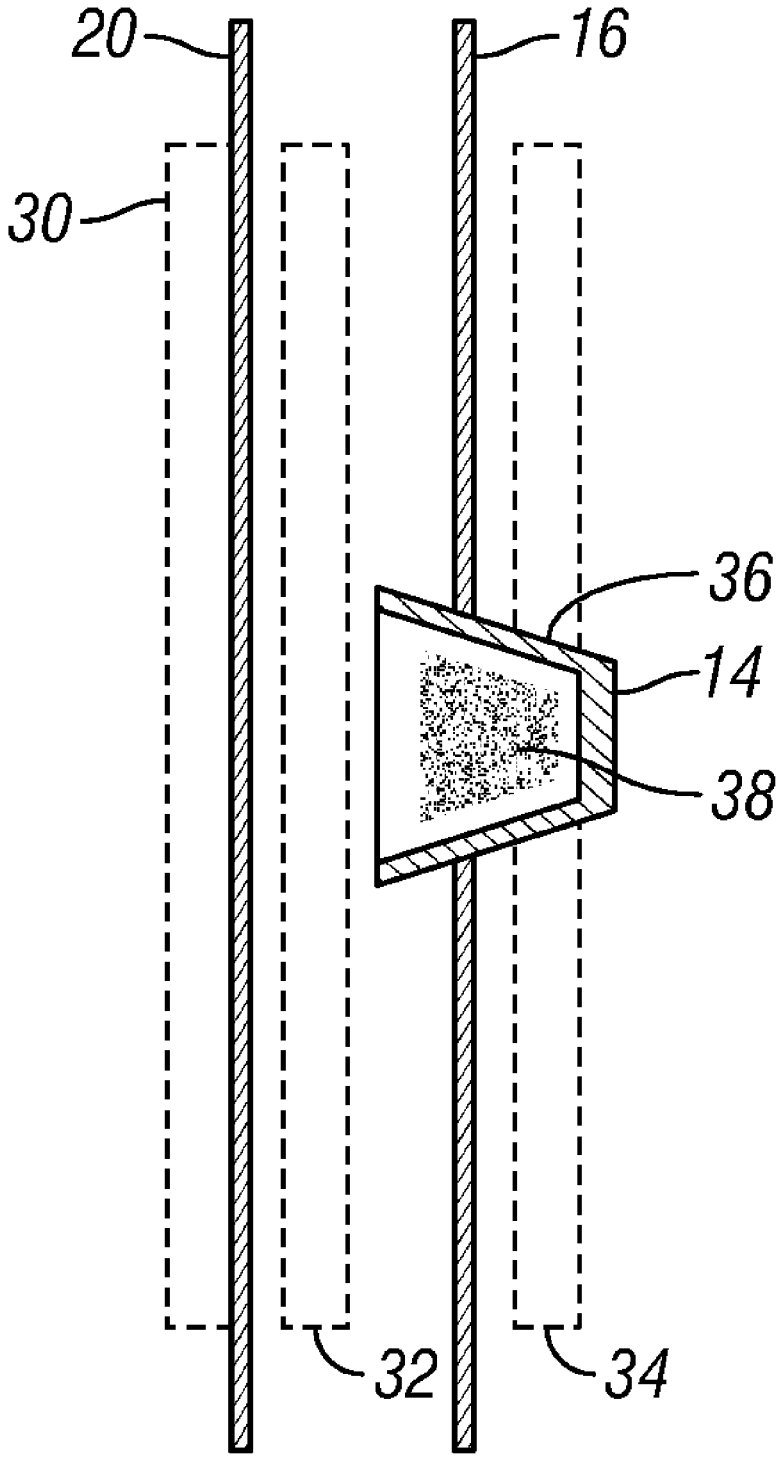
FIG. 2 is a schematic sectional view of a portion of the FIG. 1 embodiment.

Referring now to FIG. 2, there is illustratively shown a section of the perforating gun 10. In FIG. 2, there is sectionally shown the shaped charge 14, the charge tube 16, and the carrier tube 20. In one arrangement, a volume of gas-generating material, shown with dashed lines and labeled 30, can be positioned external to the carrier tube 20. For example, the external volume of gas-generating material 30 can be formed as a sleeve or strip fixed onto the carrier tube 20. In another arrangement, a volume of gas-generating material, shown with dashed lines and labeled 32, can be positioned internally within the carrier tube 20 and external to the charge tube 16. In another arrangement, a volume of gas-generating material, shown with dashed lines and labeled 34, can be positioned internal to the charge tube 16. Additionally, a volume of gas-generating material can be positioned adjacent to the shaped charges 16 such as in an adjoining sub (not shown).

In still other embodiments, one or more elements making up the perforating gun 10 can be formed from the gas-generating material. For example, a casing 36 of the shaped charge 14 can be formed partially or wholly from a gas-generating material. In another arrangement, a volume of gas-generating material 38 can be positioned inside the casing 38. In still other arrangements, the carrier tube 20, charge tube 16 or other component of the perforating gun 10 can be formed at least partially of a gas-generating material.

Figure 3:
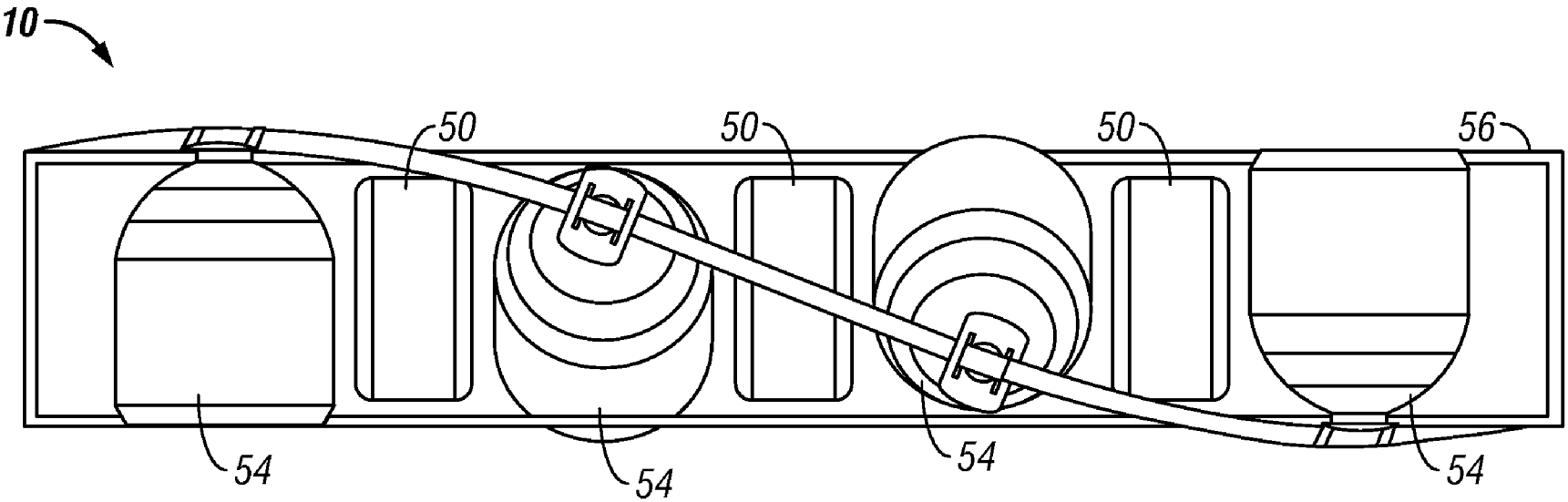
FIG. 3 is a schematic sectional view of a perforating gun made in accordance with one embodiment of the present disclosure.

Referring now to FIG. 3, there is illustratively shown an embodiment of a perforating gun 10 that includes a reactant composite material 50 to generate a high-pressure gas that may be used to clean a perforation. In FIG. 3, there are shown shaped charges 54, and a charge holder 56. The gun 10 may also include a carrier or housing (not shown). In one arrangement, one or more pellets of reactant composite material (RCM) 50 are positioned between or interleaved with the shaped charges 54. The term "pellet" is used to generally denote a body that may be manipulated and disposed between the shaped charges 54. The pellets may be disk-shaped, ring-shaped, rectangular, spherical or another geometric shape. The charge holder 56 may be a member such as a strip or tube configured to receive the shaped charges 54.

In embodiments, the RCM may be formulated to increase the power, performance and/or usefulness of a shaped charged explosive by making available sufficient oxidizing compounds for reaction with the carbon residue that occurs from the detonation of the shaped charge. This oxygen can initiate a deflagration reaction that follows the detonation of the shaped charge. By way of illustration, the following balance equation shows the products of reaction resulting from the detonation of TNT:

$$C_6H_2(NO_2)3CH_3=6CO+2.5H_2+1.5N_2+C \qquad \text{Eq. (1)}$$

As can be seen, the carbon is not fully converted to Carbon Monoxide because of insufficient available oxygen. Explosives with free carbon remaining at the completion of the chemical reaction are considered to have a negative oxygen balance (OB %). For example, TNT may have an OB % of 74%.

In embodiments of the present disclosure, the RCM supplies sufficient oxidizing material to utilize the carbon residue in a secondary reaction:

$$C(S)+O_2(g)+CO_2(g)\Delta H=-393.5\ \text{kJ} \qquad \text{Eq. (2)}$$

By way of example, the RCM may combine an oxidizer, such as Potassium Perchlorate, with an explosive, such as TNT. The manner in which the two components are mixed will control the timing and rapidity of the secondary reaction.

As shown in the FIG. 3 embodiment, the RCM 50 may be a pellet that includes an oxidizer and the shaped charge 54 may include a fuel; e.g., a case of the shaped charge may be formed of a metal such as zinc. The pellet many include an oxidizer and a binder, but no functional amount of fuel. As described previously, the pellet may be positioned between each shape charge 54. The detonation of the shaped charges 54 results in the gun body filling with the combustion gases containing free carbon. The shock and pressure from the explosion fragments the shaped charge 54 and the RCM 50. This may be a turbulent process that mixes the carbon and oxidizer. The heat from the explosive reaction ignites the mixture of carbon and oxidizer. The pressure generated by this deflagration cleans the perforation and may create fractures in the rock surrounding the perforation tunnel.

In one variant of the FIG. 3 embodiment, the RCM pellet 50 may include an oxidizer and a fuel. The fuel may be in the form of a wrapping made of paper or aluminum that encloses the pellets. In embodiments, a fuel such carbon or metal may be added to the pellets to fully balance the secondary chemical reaction. In such embodiments, the pellet may include an oxidizer, a fuel and a binder.

Figure 4:
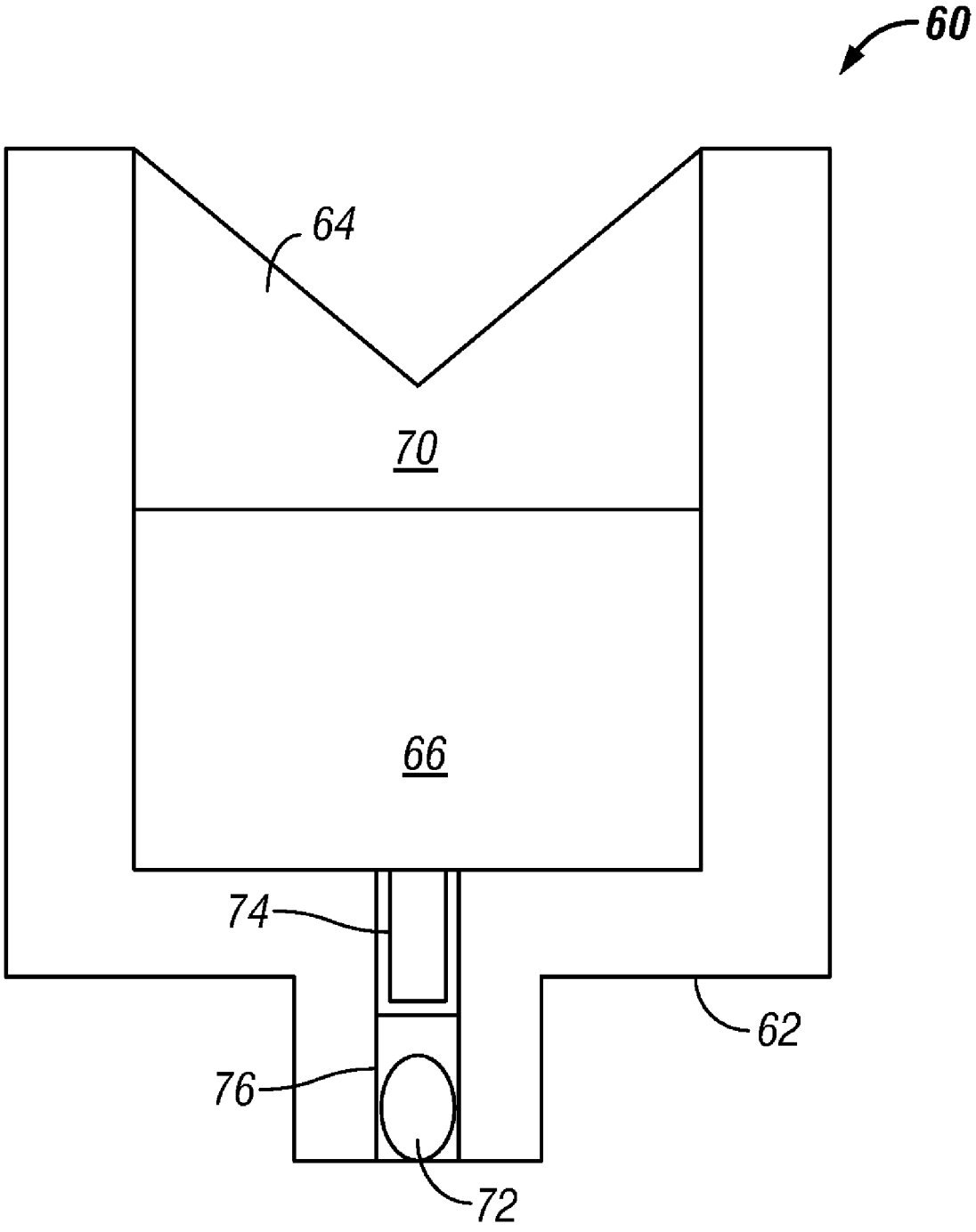
FIG. 4 is a schematic sectional view of a shaped charge gun made in accordance with one embodiment of the present disclosure.

It should be understood that the oxidizer may be positioned elsewhere in the perforating gun. Illustrative examples of embodiments utilizing the oxidizer in a shaped charge 60 are discussed with reference to FIG. 4. In FIG. 4, the shaped charge 60 includes a casing 62, a liner 64, an explosive material 66, and a oxidizer 70. The casing 62 has an opening 72 for receiving a detonator cord 74 and possibly a booster 76. The explosive material 66 and oxidizer 70 may be disposed within the casing 62. The explosive material 66 may be any material adapted to form the liner 64 into a jet upon detonation (e.g., RDX, HMX, PS, HNS, PYX, and NONA). In the shown arrangement, the oxidizer 70 is positioned between the explosive charge 66 and the metal liner 64. The shock wave from the detonation of the explosive 66 passes through the oxidizer layer 70 to collide with and collapse the liner 64. The collapse of the liner 64 results in the formation of a jet-piercing a wellbore tubular such as a well casing. The momentum of the jet-forming process may inject the oxidizer 70 into the perforation tunnel. This injection process may be extremely turbulent and enable the mixing of the oxidizer 70 with the carbon residue of the burned explosive material 66. The residue heat of the explosive jet may initiate a deflagration of the mixture of the oxidizer 70 and the carbon residue. The pressure generated by this deflagration may clean the perforation and create fractures into the rock surrounding the perforation tunnel. In a variant, the oxidizer 70 may be positioned between the explosive charge and the metal charge case 62. The shock wave from the detonation of the explosive 66 passes through the oxidizer layer 70 and results in the fragmentation of the charge case 62. Inside the perforating gun body, the heat from the detonation of the explosive material 66 initiates a deflagration of the oxidizer 70 and a residue carbon mixture. The pressure generated by this deflagration cleans the perforation and may create fractures into the rock surrounding the perforation tunnel.

Figure 5:
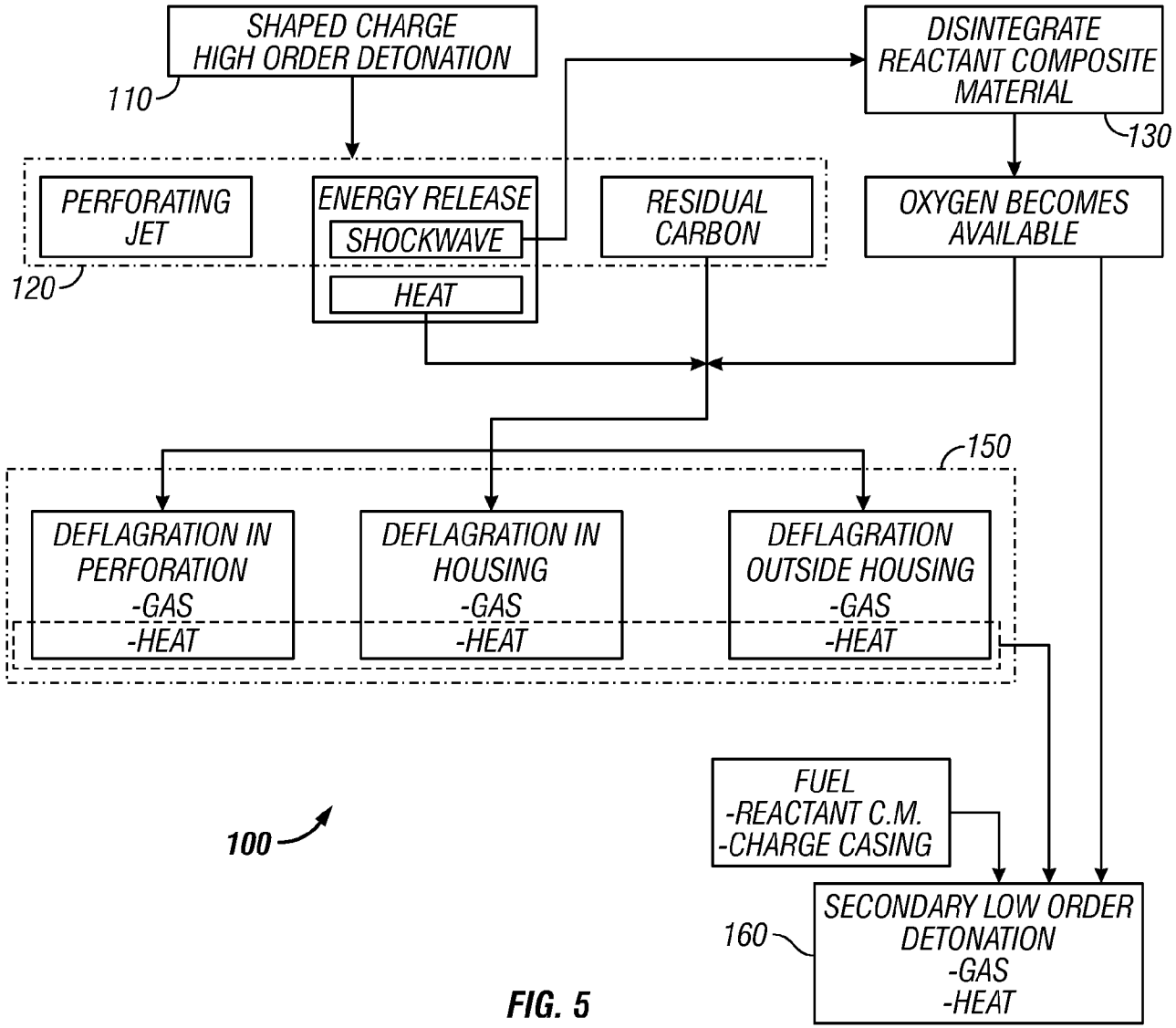
FIG. 5 is a flowchart illustrating embodiments of methods for perforating and fracturing a formation according to the present disclosure.

Referring now to FIG. 5, there is shown illustrative methodologies for utilizing gas-generating material to perforate a formation. In connection with a perforating gun as shown in FIG. 1, a method 100 for cleaning perforations in a formation with gas-generating material can be initiated by detonation of one or more perforating charges at step 110 by using the detonator cord or other suitable device. The RCM material is not detonated by the detonator cord or other suitable device. In a conventional manner, the detonation is followed at step 120 by a formation of a perforating jet that penetrates the formation and forms a perforation in the formation, a release of heat or thermal energy, a shockwave, and resulting formation of carbon residue. It should be understood that these other steps may occur substantially simultaneously but are merely discussed in a sequence for ease of explanation. The shockwave disintegrates the RCM at step 130, which allows an oxidizer that makes oxygen available at step 140. Thus, prior to the pulverization or disintegration, the RCM does not burn or ignite in any functional sense. The heat applied to the newly-available oxygen and residual carbon initiates a deflagration at step 150 that has several distinct phases. A deflagration occurs in the housing, a deflagration occurs in the wellbore but outside the housing, and a deflagration occurs in the perforation. The deflagration at step 150 also provides thermal energy that may be used to initiate a second deflagration at step 160. The second deflagration uses a fuel supplied in the perforating gun and the newly-available oxygen. The fuel may be in the RCM, in the casing of the shaped charge or in another component of the perforating gun. The high pressure gas generated by the first and second deflagrations enters and cleans the perforations in the formation.

Referring now to FIG. 1, the use of deflagrations that follow a detonation of shaped charges in the manner described above may reduce the fluid pressure inside the perforating gun 10. This reduction in pressure may prevent the perforating gun 10 from bursting. The deflagrations are controlled by controlling aspects such as the magnitude of the energy released and the location of the deflagrations (e.g., inside the gun, in the wellbore, in the perforation). In addition to controlling aspects of the deflagrations, a pressure reduction in the perforating gun 10 may also be obtained by venting the perforating gun 10. One technique for venting the perforating gun 10 is to enlarge the perforations made by the shaped charges in the carrier of the perforation gun 10. Discussed below is an illustrative shaped charge configured to maximize a perforation in a carrier of the perforating gun 10 and therefore increase the out-flow of high-pressure gas from the interior of the perforating gun 10.

Figure 6:
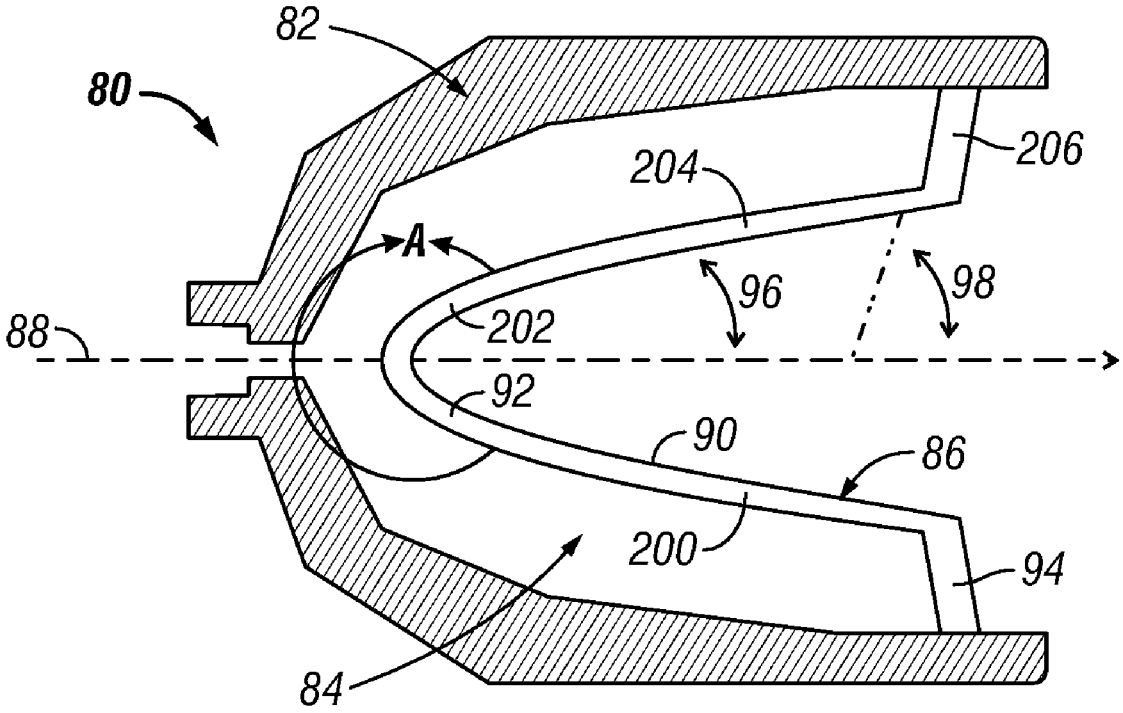
FIG. 6 is a sectional view of a shaped charge made in accordance with one embodiment of the present disclosure.

Referring now to FIG. 6, there is shown one shaped charge 80 made in accordance with the present disclosure. The charge 80 includes a casing 82 having a quantity of explosive material 84 and enclosed by a liner 86. The casing may be made of materials such as steel or zinc. Other suitable materials include particle or fiber reinforced composite materials. The casing 82 may have a geometry that is symmetric along a longitudinal axis 88. The shape of the casing 82 may be adjusted to suit different purposes such as deep penetration or large entry hole or both. As is known, the liner geometries can be varied to obtain deep penetration and small entry holes, relatively short penetration depth and large entry holes, or relatively deep penetration and relative large entry holes.

The liner 86 employs multiple angles in order to form a projectile that cuts a relatively large hole in the carrier housing 16 (FIG. 1). This relatively large hole enables the high pressure gases formed by the RCM 50 (FIG. 3) to more easily escape the interior of the housing 16 (FIG. 1). The liner 86 may generate a jet profile that includes a first shape that cuts or shears the carrier housing 16 (FIG. 1) and a second shape that perforates the formation. The jet may be one single body or two or more discrete projectiles. In one arrangement, the liner 86 is conically shaped and has a main body 90 beginning at an apex 92 and terminating at a skirt portion 94. The liner 86 is generally a thin-walled member having a thickness in the range of 0.5 to 5.0 millimeters. The wall forming of the main body 90 has a first angle 96 relative to the longitudinal axis 88 and the wall forming the skirt portion 94 has a second angle 98 to the longitudinal axis 88. Exemplary ranges for the second angle 98 range from sixty to ninety degrees or greater. In embodiments, the skirt portion 94 may be roughly five to twenty percent of the total length of the liner 86. Thus, in an aspect, a wall 200 of the liner 86 may be described as having an arcuate portion 202 at the apex 92, an intermediate conical section 204 being defined by the first angle 96 relative to a longitudinal axis 88, and a terminating conical section 206 being defined by the second angle 98 relative to the longitudinal axis 88. It should be appreciated that while sharp angles are shown at the adjoining edges, radii or other such features may be utilized at those adjoining edges.

It should be appreciated that the first and second angles 96 and 98 enable their associate portions of the liner 86 to respond or react differently to the shock wave applied from a detonation. For instance, the first angle 96 may be selected such that the shock wave folds the intermediate conical section 204 into the perforating jet. The second angle 98 may be selected such that the shock wave forms the terminating conical section 206 into a disk or platen-type object having a larger diameter than the perforating jet. In one aspect, the first and second angles 96 and 98 orient the walls making up intermediate conical section 204 and the terminating conical section 206 to have different impact angles with the shock wave traveling through the shaped charge. In another aspect, the first and second angles 96 and 98 orient the walls making up intermediate conical section 204 and the terminating conical section 206 to allow a functionally effective amount of explosive material behind the skirt portion 94. By functionally effective amount, it is meant that there is sufficient explosives in order to shape and propel a jet formed by the skirt portion 94 in a desired manner.

The liner 86 may be formed of powder metals or powder metals blended with ductile materials such as aluminum, zinc, copper, tungsten, lead, bismuth, tantalum, tin, brass, molybdenum, etc. Materials such as plasticizers or binder may also be included in a material matrix of the liner 86. The liner 86 may also be formed of malleable solid or sheet metals such as copper, zinc, and Pfinodal. Reactive or energetic materials may also be utilized in the liner 86. In some embodiments, the liner 86 is made of a single material or blend of materials. In other embodiments, the liner 86 utilizes two or more different materials. For example, the skirt portion 94 may be formed of a material different from the material used in the remainder of the liner 86.

In certain applications, an oxidizer may be used in conjunction with the gas-generating material. Suitable oxidizers include potassium sulfate and potassium benzoate. The oxygen released by the oxidizers can combine with a metal fuel such as zinc and/or with carbon or hydrogen (e.g., rubber). Also, materials such as calcium sulfate hemihydrate can function as both a hydrate and a high temperature oxidizer. Additionally, material can be used in conjunction with the gas-generating material to increase the available heat of reaction. Suitable materials include a metal such as finely divided aluminum.

From the above, it should be appreciated that what has been disclosed includes, in part, a method for perforating a formation intersected by a wellbore. The method may include positioning a shaped charge and a reactant composite material in a carrier; positioning the carrier in the wellbore; detonating the shaped charge; and disintegrating the reactant composite material using a shock generated by the detonated shaped charge. The method may also include initiating a first deflagration by using carbon and heat resulting from the detonation of the shaped charge and an oxygen component of the disintegrated reactant composite material. In embodiments, the method may also include initiating a second deflagration using heat from the first deflagration. Such initiating may include applying the heat to an oxygen component of the disintegrated reactant composite material and a fuel. The fuel may be supplied by a case of the shaped charge and/or a support member for the shaped charge. The support member may be a tube or strip. In embodiments, the reactant composite material may include an oxidizer and an inert binder. In one configuration, the reactant composite material may not include a fuel component. In other configurations, the reactant composite material may include an oxidizer, a fuel component and an inert binder. Also, the reactant composite material may be formulated to be oxygen overbalanced in any of these embodiments.

From the above, what has been disclosed also includes a system for perforating a formation intersected by a wellbore. The system may include a carrier, a shaped charge positioned in the carrier; and a reactant composite material positioned in the carrier. The reactant composite material may be configured to disintegrate upon detonation of the shaped charge. In arrangements, the reactant composite material may be interposed between shaped charges. Also, the reactant composite material may include an oxygen component in an amount sufficient to consume substantially all of the carbon resulting from detonation of the shaped charge.

From the above, what has been disclosed further includes a method for perforating a formation intersected by a wellbore. The method may include positioning a plurality of shaped charges and a plurality of pellets formed at least partially of reactant composite material in a carrier; positioning the carrier in the wellbore; disintegrating the plurality of pellets by detonating the plurality of shaped charges; generating a first quantity of gas using carbon and heat resulting from the detonation of the shaped charge and an oxygen component of the disintegrated reactant composite material; and generating a second quantity of gas by applying heat resulting from the generation of the first quantity of gas to an oxygen component of the disintegrated reactant composite material and a fuel.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

The invention claimed is:

1. A method of perforating a formation intersected by a wellbore, comprising:

forming a plurality of pellets at least partially of a reactant composite material;

positioning a plurality of shaped charges along a charge holder;

interleaving the plurality of pellets with the plurality of shaped charges, wherein the plurality of pellets are inside the charge holder;

positioning the charge holder inside a carrier;

conveying the carrier in the wellbore using a conveyance device;

detonating the shaped charges with a detonating cord, the detonation of the shaped charges thereby releasing carbon;

preventing the detonator cord from detonating the plurality of pellets;

disintegrating the plurality of pellets using a shock generated by the detonated shaped charges to thereby release oxygen;

perforating the formation using the shaped charges;

mixing the released oxygen and the released carbon; and initiating a first deflagration using the mixture of released carbon and released oxygen to generate a pressure that is applied to the perforations formed by the shaped charges.

2. The method of claim 1 further comprising initiating the first deflagration by using heat resulting from the detonation of the shaped charges, wherein the reactant composite material is not detonated by the detonator cord.

3. The method of claim 2 further comprising initiating a second deflagration using heat from the first deflagration.

4. The method of claim 3 wherein the initiating the second deflagration includes applying the heat to an oxygen component of the disintegrated reactant composite material and a fuel.

5. The method of claim 4 wherein the fuel is supplied by one of: (i) a case of the shaped charge; and (ii) a support member for the shaped charge.

6. The method of claim 1 wherein the reactant composite material includes an oxidizer and an inert binder, the reactant composite material including substantially no fuel component.

7. The method of claim 1 wherein the reactant composite material is oxygen overbalanced.

8. The method of claim 1 wherein the reactant composite material includes an oxidizer, a fuel component and an inert binder, and wherein the reactant composite material is oxygen overbalanced relative to the released carbon.

9. The method of claim 1 wherein the pellets are disk-shaped.

10. A system for perforating a formation intersected by a wellbore, comprising:

a carrier;

a charge holder positioned inside the carrier;

a plurality of shaped charges positioned along the charge holder;

a plurality of pellets at least partially formed of a reactant composite material positioned in the charge holder and interleaved with the plurality of shaped charges, the plurality of pellets being configured to disintegrate upon detonation of the plurality of shaped charges, wherein an axial space separates each of the plurality of shaped charges, and wherein each axial space includes at least one pellet of the plurality of pellets; and a detonator cord configured to detonate the plurality of shaped charges but not the plurality of pellets.

11. The system of claim 10 wherein at least one pellet of the plurality of pellets is interposed between two of the plurality of shaped charges.

12. The system of claim 11 wherein the plurality of pellets are disk-shaped.

13. The system of claim 10 wherein the reactant composite material includes an oxygen component in an amount sufficient to consume substantially all of the carbon resulting from detonation of the shaped charge.

14. A system for perforating a formation intersected by a wellbore, comprising:

a carrier;

a charge holder positioned inside the carrier;

a plurality of shaped-charges positioned along the charge holder;

a plurality of disk-shaped pellets formed at least partially formed of a reactant composite material positioned in the charge holder; wherein the plurality of pellets are interleaved with the plurality of shaped-charges such that one pellet is positioned between two shaped charges.

15. A method for perforating a formation intersected by a wellbore, comprising:

perforating the formation using an apparatus, the apparatus comprising:

a carrier;

a charge holder positioned inside the carrier;

a plurality of shaped charges positioned along the charge holder;

a plurality of pellets at least partially formed of a reactant composite material positioned in the charge holder and interleaved with the plurality of shaped charges, the plurality of pellets being configured to disintegrate upon detonation of the plurality of shaped charges, wherein an axial space separates each of the plurality of shaped charges, and wherein each axial space includes at least one pellet of the plurality of pellets; and a detonator cord configured to detonate the plurality of shaped charges but not the plurality of pellets.

* * * * *